United States Patent [19]

Penwell

[11] 4,068,942

[45] Jan. 17, 1978

[54] ADVANCED PHOTORECEPTOR

[75] Inventor: Richard C. Penwell, Penfield, N.Y.

[73] Assignee: Xerox Corporation, Stamford, Conn.

[21] Appl. No.: 621,890

[22] Filed: Oct. 14, 1975

[51] Int. Cl.[2] ..... G03G 15/00

[52] U.S. Cl. ..... 355/16; 242/192; 355/3 DR

[58] Field of Search ..... 355/16, 3 BE, 3 DR, 355/17; 242/192, 67.3 R

[56] References Cited

U.S. PATENT DOCUMENTS

| | | | |
|---|---|---|---|
| 2,690,106 | 9/1954 | Trump | 355/104 |
| 2,789,776 | 4/1957 | Begun et al. | 242/67.3 R |
| 3,520,495 | 7/1970 | Sotani | 242/192 |
| 3,563,734 | 2/1971 | Shely | 355/16 X |
| 3,588,242 | 6/1971 | Berlier et al. | 355/16 |
| 3,706,489 | 12/1972 | Moxness | 355/3 DR |
| 3,737,230 | 6/1973 | van Meijel et al. | 355/16 X |
| 3,826,570 | 7/1974 | Kolibas | 355/3 DR |
| 3,941,472 | 3/1976 | Nagahara et al. | 355/16 |

*Primary Examiner*—Richard L. Moses

[57] ABSTRACT

An advanceable photoreceptor comprising a hollow drum and an elongated web of photosensitive material the bulk of which is supported internally of the hollow drum while a portion thereof is supported on the outer surface of the drum. The bulk of the photosensitive web material is supported internally of the hollow drum by means of a supply roll and a takeup roll which are supported for repositioning periodically in order to provide for the accommodation of a greater length of photosensitive web material than heretofore possible.

3 Claims, 4 Drawing Figures

ADVANCED PHOTORECEPTOR

BACKGROUND OF THE INVENTION

This invention relates to copying or reproducing apparatus wherein electrostatic images are formed on a light sensitive surface with subsequent development of the latent images formed thereby and more particularly to an advanceable photoreceptor construction for use therein.

In the process of xerography and other processes wherein latent electrostatic images are formed by electrostatic charges on a light sensitive substrate material, the image of an original to be copied or reproduced is typically recorded in the form of latent electrostatic images upon a photosensitive or other charge-retentive member with subsequent rendering of the latent image visible by the application of electroscopic marking particles, commonly referred to as toner. The latent images may also be formed on the photosensitive member by exposing a uniformly charged photosensitive member to an optical image corresponding to intelligence generated by electronic means.

In the earliest developments of the technology, the photosensitive member was constructed in the form of a drum which was supported for rotation such that a uniform electrostatic charge could be first placed on the photosensitive member with subsequent exposure of a light image in order to discharge portions of the photosensitive member in accordance with the light images and then the image portion of the photosensitive member is moved past a development station where the electrostatic images were rendered visible by means of application of toner particles which would electrostatically adhere to the photosensitive member in the areas thereof still containing electrostatic charges.

Subsequent developments, in the photosensitive member area, designed to improve the performance (i.e. less maintenance, etc.) of the reproducing apparatus led to the development of what has become known as an advanceable photoreceptor. The advanceable photoreceptor comprises a web of photosensitive or photoreceptor material the bulk of which is supported internally of a hollow drum while a portion thereof is trained over the outer surface of the drum for employmemt in the image forming process. The bulk of the web is supported internally of the drum by a supply roll containing unused photosensitive material and a takeup roll which contains photoreceptor material already used. In operation, the portion of photosensitive material entrained on the surface of the drum is utilized until such time as the effectiveness thereof for such purposes begins to diminish or becomes unsuitable for such purposes. At that time, the transport mechanism comprising the takeup reel and supply reel is actuated either automatically or manually in order to move the used photoreceptor material onto the takeup reel and move unused photoreceptor material from the supply reel to the surface of the hollow drum. Obviously, the foregoing construction is limited as to the capacity of photoreceptor material that can be stored internally of the drum for a given sized drum.

Accordingly, a primary object of this invention is to provide an improved copier apparatus.

Another object of this invention is to provide, in a xerographic copier apparatus, an improved advanceable photoreceptor construction.

Still another object of this invention is to provide, in a xerographic copier or reproducing apparatus, a photoreceptor construction in the form of an advanceable photoreceptor structure which provides greater capacity than structures of the prior art.

BRIEF SUMMARY OF THE INVENTION

Briefly, the above-cited objects are accomplished by the provision, in a xerographic reproducing apparatus, an advanceable photoreceptor construction having a hollow drum in which the bulk of an elongated photosensitive web is supported by a supply member and a takeup member while a portion of the photosensitive web is trained over the outer surface of the hollow drum for utilization in the electrostatic image forming process.

In one embodiment of the invention, the support for the photoreceptor drum is external to the hollow drum thereby allowing the space which would ordinarily be taken up by the internal support structure for the drum to be utilized for increasing the capacity of the photosensitive material which can be stored internally of the drum. In this embodiment the web material is supported internally of the drum by a supply roll and a takeup roll between which the material is transported from the former to the latter, the positions of the rolls being fixed relative to each other and to the drum.

In another form of the invention, the supply and takeup members are adjustably supported internally of the hollow, externally-supported drum so that they can be repositioned as the photoreceptor material is transported from the supply roll to the takeup roll. It has been found that one limitation on the capacity of photoreceptor material that can be stored internally of the drum is that the supply and takeup rolls are supported in the same position internally of the drum regardless of the amount of material thereon. By providing for movement of the rolls as the material is transferred between the supply roll and the takeup roll a greater quantity of photosensitive material can be stored therein.

In each of the contemplated embodiments the photosensitive web is periodically transported from the supply roll to the takeup roll as required. In the latter discussed embodiment the rolls are also repositioned on a periodic basis.

Other objects and advantages of the present invention will become apparent when read in conjunction with the accompanying drawings.

DETAILED DESCRIPTION OF THE PREFERRED EMBODIMENT

Figure 1:
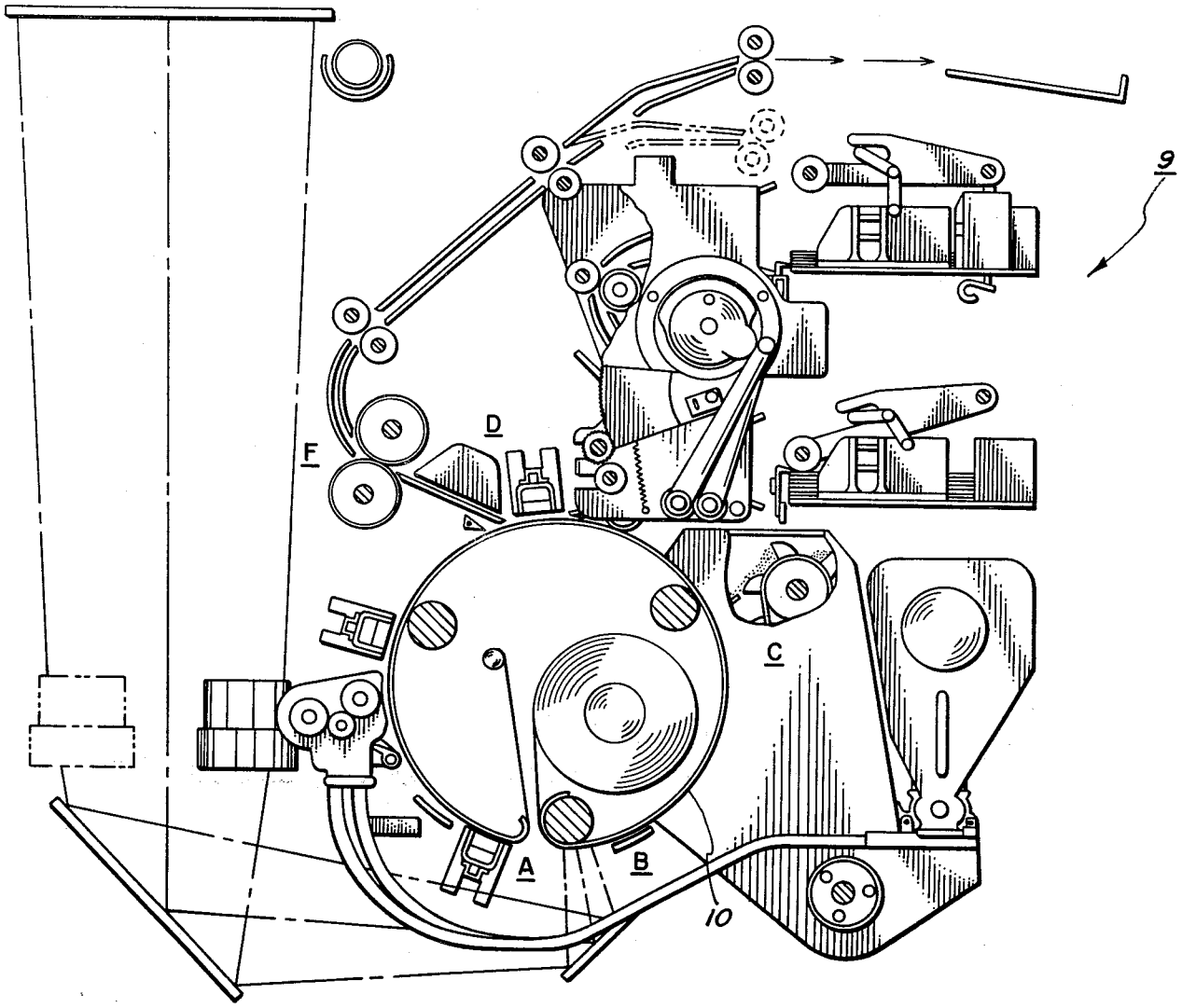
FIG. 1 is a schematic representation of a xerographic reproducing apparatus incorporating the advanceable photoreceptor construction forming a part of this invention.

Referring now to the drawings, especially FIG. 1, there is disclosed an automatic xerographic reproducing machine or apparatus 9. The automatic xerographic reproducing machine includes a xerographic plate, or surface 10, in the form of an advanceable photoreceptor. The plate is in the form of an elongated flexible web comprising a photoconductive layer or light sensitive surface on a conductive backing which is partially trained over the outer surface of a hollow drum 12. The drum is supported for rotation which causes the plate surface to sequentially pass a series of xerographic processing stations.

For purposes of the present disclosure the several xerographic processing stations in the path of movement of the plate surface may be described functionally as follows:

a charging station A where a uniform electrostatic charge is deposited onto the photoconductive plate;

an exposure station B, at which light or radiation patterns of copies to be reproduced is projected onto the plate surface to dissipate the charge in the exposed areas thereof, to thereby form latent electrostatic images of the copies to be reproduced;

a developing station C, at which xerographic developing material including toner particles having an electrostatic charge opposite to that of the latent electrostatic images is cascaded over the latent electrostatic images to form powder images in configuration of the copy being reproduced;

a transfer station D, where the powder images are electrostatically transferred from the plate surface to a transfer material such as paper, which then is passed through a heated pressure fusing system according to the present invention as will be described hereinafter; and a drum cleaning and discharge station E, at which the plate surface is brushed to remove residual toner particles remaining thereon after image transfer and at which the plate is exposed to a relatively bright light source to effect substantially complete discharge of any residual electrostatic charge remaining thereon.

For further details of the xerographic processing stations discussed above, reference may be had to U.S. Pat. No. 3,578,859.

Figure 2:
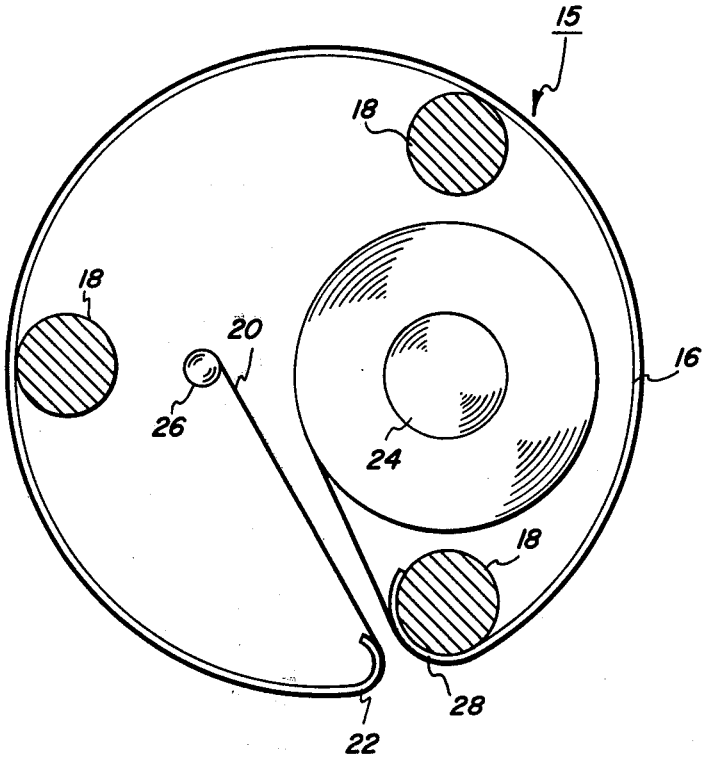
FIG. 2 is a schematic representation of an end view of an advanceable photoreceptor construction forming part of the apparatus illustrated in FIG. 1.

The advanceable photoreceptor 10 as disclosed in FIG. 2 comprises the hollow drum 12 which is supported adjacent its ends by a plurality of support rolls 18 which are disposed internally of the drum adjacent the ends thereof. In order to effect rotation of the drum, the members 18 may be provided with means for imparting motion thereto which in turn imparts motion to the drum 12 either by friction between the members 18 and the internal surface of the drum contacted thereby or, alternatively, through a positive driving arrangement wherein the members 18 comprise gears which engage gear teeth formed in the end of the drum 16. Alternatively, end caps could be employed which would be secured to the ends of the drum 12. In any event, the conventional shaft support structure which heretofore has beem employed in photoreceptor drum structures has been purposely omitted from the internal confines of the drum 12 in order to provide for a greater capacity or storage capacity of photoreceptor material.

A quantity of photoreceptor material in the form of an elongated web 20 is supported relative to the drum 12 such that the bulk thereof is contained internally of the hollow drum 12 while a portion 22 is trained over the outer surface of the drum. A supply roll 24 rotatably supported within the drum 12 serves to support unused photoreceptor material while a roll member 26 serves as a takeup roll for storing used photoreceptor material.

Mechanism for automatically effecting periodic rotation of the roll members 24 and 26 so that a new portion of photoreceptor material can be trained over the surface of the drum 16 may be provided in accordance with well known techniques and design know-how or the rolls 24 and 26 may be simply adapted for manual rotation thereof by a maintenance man. Any suitable mechanism for accomplishing the actuation of the rolls so as to transport the photoreceptor material 20 from the roll 24 to the roll 26 may be employed. Friction or other types of retard devices may be employed for insuring that the portion of the web material on the surface of the drum remains in a taut condition.

Also, the photosensitive web 20 may be of any well known type suitable for the intended purposes.

The drum 12 is provided with an elongated slot 28 through which the photoreceptor web material 20 can be brought out of the inside of the drum 16. It will be appreciated that the slot is substantially coextensive with the longitudinal axis of the drum and that the width of the photoreceptor material 20 is such that the photoreceptor material is disposed between the roll members 18 adjacent the ends of the drum 16, the width of the slot 28 corresponding substantially to the width of the photoreceptor material. In this embodiment of the invention, the rolls 24 and 26 are mounted in fixed positions.

Figure 3:
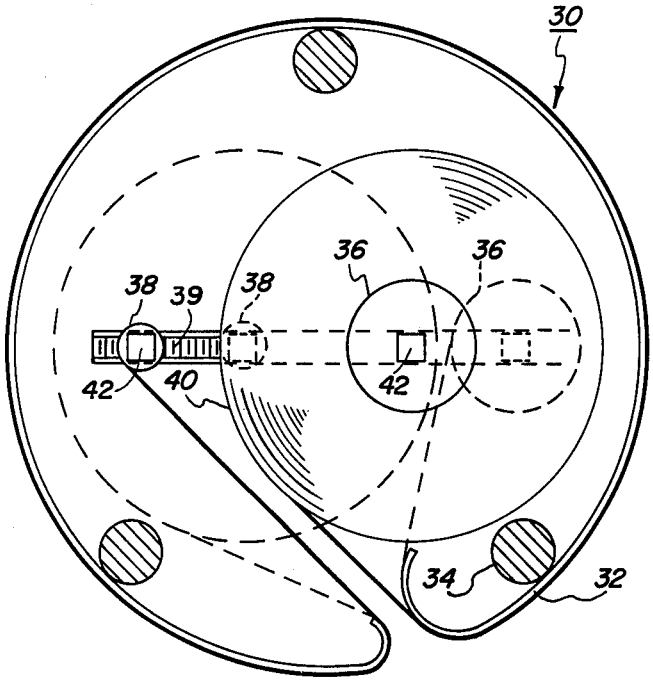
FIG. 3 is a schematic end view of a modified form of the photoreceptor construction illustrated in FIG. 2.
Figure 4:
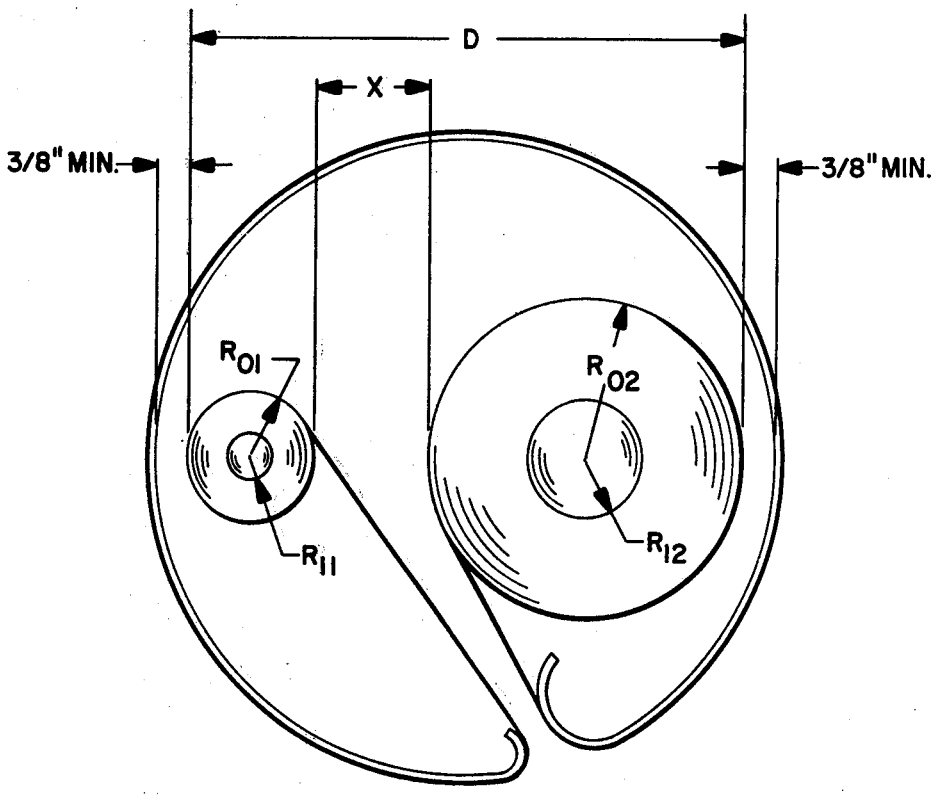
FIG. 4 is a schematic representation of an advanceable photoreceptor construction corresponding to that disclosed in FIG. 3 but shown schematically so as to represent certain terms utilized in expressions or equations for determining the length of photoreceptor material that can be stored internally of a drum construction.

A modified form of the invention, as disclosed in FIG. 3 comprises an advanceable photoreceptor construction 30 including a hollow drum structure 32 and a plurality of roll members 34 which support the drum structure adjacent the ends thereof such that the drum can be rotated either by the roll members 34 through frictional engagement with the end of the drum 32 or through positive coupling therebetween or by separate drive means.

The embodiment disclosed in FIG. 3 differs from that of FIG. 2 in that the supply roll 36 and the takeup roll 38 are supported internally of the drum 32 such that they can be moved along the diameter of the drum as the photosensitive web material 40 is transported from the roll 36 to the roll 38. As will be appreciated, as the web material on the supply roll 36 is depleted its diameter decreases and the diameter of the takeup roll 38 increases. Accordingly, by mounting the rolls 36 and 38 on adjustable centers, the rolls 36 and 38 can be repositioned in accordance with the amount of material thereon. For example, as shown in FIG. 3 roll 36 occupies the solid line position illustrated when the supply roll has its largest quantity of material thereon. At the same time, the roll 38 occupies the solid line position illustrated in FIG. 3. In a second position of the rolls 36 and 38 they occupy the positions illustrated in FIG. 3 in dotted line.

In order to accomplish the repositioning of the rolls 36 and 38 a threaded rod 39 disposed in a keyway engages support structures 42 forming a part of the ends of the rolls 36 and 38.

In a configuration such as illustrated in FIG. 2 where the positions of the supply and takeup rolls are fixed, the length of photoreceptor material that can be stored inside the drum 12 can be determined in accordance with the following formulas:

$$l = \pi (R_{o2}^2 - R_{i2}^2)/\Delta r$$

$$R_{o1} = \sqrt{\frac{R_{o2}^2 + R_{i1}^2}{\sqrt{2}}} \text{ and}$$

$$d = 2R_{o2} + 2R_{o1} + x$$

where:

$l$ = length of the photoreceptor web
$R_{o2}$ = initial outside radius of the supply roll
$R_{i2}$ = inside radius of the supply roll
$\Delta r$ = the thickness of web
$R_{o1}$ = outside radius of the takeup roll when it and the supply roll are equal in size.
$R_{i1}$ = inside radius of takeup roll
$d$ = maximum allowable space for the system in a drum, and
$x$ = the distance between the outside of the supply and takeup rolls at any time Where $d$ = 8 inches and $\frac{3}{8}$ of an inch is allowed between maximum size of rolls and drum and $x$ is a minimum of $\frac{1}{4}$ inch and with $R_{i1}$ equal to $\frac{1}{4}$ inch and $R_{i2} = \frac{3}{4}$ of an inch, the length ($l$) of a 7 mil thick photoreceptor material equals 136 feet.

Where the positions of the supply and takeup rolls can be adjusted as indicated in conjunction with the embodiment of FIG. 3, the expression representing $d$ becomes $d = 4R_{o1} + x$. Utilizing the same numbers given above, the photoreceptor length ($l$) now becomes approximately 205 feet or approximately 50% more than the configuration where the positions of the roll members are fixed.

For the maximum length of photoreceptor material of 205.7 feet slightly over 38 feet of photoreceptor material can be transported from the supply roll to the takeup roll before initial repositioning of the rolls is required. With a diameter of 8 inches the circumference of the drum 12 is approximately 25 inches. Accordingly, for 38 feet of web material, approximately 76 sections or portions are available for replenishing the material on the drum surface before repositioning is required. It has also been determined that succeeding amounts of material which can be transported become smaller and smaller.

By reducing the maximum amount of photoreceptor material to 194.4 feet it was determined that only five repositioning steps are compared to the many steps required in the foregoing example required after the initial setup in order to utilize the entire quantity of photoreceptor material. In this example, the minimum amount of photoreceptor material transported is 23.67 feet of photoreceptor material which could last for a period of months depending upon the utilization of the machine. This 24 feet of photoreceptor material would be equivalent to the amount that could be utilized between scheduled maintenance calls.

For a stored length of 185.5 feet, representing a 10% decrease from the maximum, only three repositioning steps would be required with a minimum of 48 feet of photoreceptor material being available at any new position. The repositioning could be accomplished manually perhaps even by trained office personnel by simple actuation of the thread rod 39 by means of a handle (not shown).

While the present invention has been disclosed in conjunction with the preferred embodiments thereof, it will be appreciated that modifications within the scope of the invention will become apparent to those skilled in the art and it is intended that such modifications be covered by the claims appended hereto.

What is claimed is:

1. Advanceable photoreceptor apparatus comprising:
a hollow drum having slot means substantially coextensive with the longitudinal axis of said drum;
an elongated photosensitive web;
means for supporting a major portion of said photosensitive web internally of said drum while a smaller portion thereof is trained through said slot means over the outer surface of said drum, said major portion supporting means comprising a supply member and a takeup member;
means for effecting periodic movement of said photosensitive web from said supply member to said takeup member;
means for stationarily supporting said supply and takeup members in various positions internally of said drum;
means for effecting periodic repositioning of said members independently of movement of said photosensitive web after a predetermined quantity of photoreceptor has been transferred from said supply member to said takeup member; and
said means for periodically repositioning said members including a threaded rod operatively coupled to supports for said members.

2. Apparatus according to claim 1 including means cooperating with the ends of said drum for supporting said drum for rotation whereby said supply and said takeup members are unobstructed by said support means.

3. Advanceable photoreceptor apparatus comprising:
a hollow drum having slot means substantially coextensive with the longitudinal axis of said drum;
an elongated photosensitive web;
means for supporting a major portion of said photosensitive web internally of said drum while a smaller portion thereof is trained through said slot means over the outer surface of said drum, said major portion supporting means comprising a supply member and a takeup member;
means for effecting periodic movement of said photosensitive web from said supply member to said takeup member;
means for stationarily supporting said supply and takeup members in various positions internally of said drum, and
means for effecting periodic repositioning of said members independently of movement of said photosensitive web after a predetermined quantity of photoreceptor has been transferred from said supply member to said takeup member;
the maximum length ($l$) of said photosensitive web being determined in accordance with the formulas:

$$l = \pi (R_{o2}^2 - R_{i2}^2)/\Delta r;$$

$$R_{o1} = \sqrt{R_{o2}^2 + R_{i1}^2} \text{ and } \sqrt{2}$$

$$d = 2r_{o2} + 2r_{o1} + x$$

where $l$ = length of the photoreceptor web $R_{o2}$ = initial outside radius of the supply roll $R_{i2}$ = inside radius of the supply roll $\Delta r$ = the thickness of web $R_{o1}$ = outside radius of the takeup roll when it and the supply roll are equal in size $R_{i1}$ = inside radius of takeup roll $d$ = maximum allowable space for the system in a drum, and $x$ = the distance between the outside of the supply and takeup rolls at any time.

* * * * *